US011808139B2

(12) United States Patent
Kabrich et al.

(10) Patent No.: US 11,808,139 B2
(45) Date of Patent: Nov. 7, 2023

(54) MONITORING RAMP-UP PRESSURE OF A PUMP

(71) Applicant: Caterpillar Inc., Peoria, IL (US)

(72) Inventors: Todd R. Kabrich, Tomball, TX (US); Casey A. Otten, Spring, TX (US); Yuesheng He, Sugar Land, TX (US)

(73) Assignee: Caterpillar Inc., Peoria, IL (US)

( * ) Notice: Subject to any disclaimer, the term of this patent is extended or adjusted under 35 U.S.C. 154(b) by 49 days.

(21) Appl. No.: 17/580,849

(22) Filed: Jan. 21, 2022

(65) Prior Publication Data

US 2023/0235663 A1 Jul. 27, 2023

(51) Int. Cl.

| | |
|---|---|
| ***E21B 43/26*** | (2006.01) |
| ***E21B 47/06*** | (2012.01) |
| ***F04B 49/08*** | (2006.01) |

(52) U.S. Cl.

CPC ..... *E21B 47/06* (2013.01); *E21B 43/26* (2013.01); *F04B 49/08* (2013.01); *F05D 2270/09* (2013.01); *F05D 2270/3013* (2013.01)

(58) Field of Classification Search

CPC ..... E21B 43/26

See application file for complete search history.

(56) References Cited

U.S. PATENT DOCUMENTS

| | | | |
|---|---|---|---|
| 8,205,594 | B2 | 6/2012 | Fore et al. |
| 9,255,531 | B2 | 2/2016 | Zhang et al. |
| 9,341,055 | B2 | 5/2016 | Weightman et al. |
| 9,341,056 | B2 | 5/2016 | Weightman et al. |
| 9,683,503 | B2 | 6/2017 | Zhang et al. |
| 9,889,915 | B2 | 2/2018 | Zhang et al. |
| 9,896,982 | B1 | 2/2018 | Zhang et al. |
| 10,415,348 | B2 | 9/2019 | Zhang et al. |
| 10,458,352 | B2 | 10/2019 | Zhang et al. |
| 10,563,649 | B2 | 2/2020 | Zhang et al. |
| 10,734,814 | B2 | 8/2020 | Converse et al. |
| 10,760,996 | B2 | 9/2020 | Converse et al. |
| 10,876,668 | B2 * | 12/2020 | Rogers ..... F17D 1/20 |
| 10,890,061 | B2 | 1/2021 | Cai et al. |
| 10,914,154 | B2 * | 2/2021 | Reid ..... F04B 49/02 |
| 10,927,774 | B2 | 2/2021 | Cai et al. |
| 11,131,176 | B1 | 9/2021 | Haustveit et al. |
| 11,236,739 | B2 * | 2/2022 | Yeung ..... F04B 47/02 |
| 11,335,492 | B2 * | 5/2022 | Casiraghi ..... H01F 7/1844 |
| 11,448,202 | B2 * | 9/2022 | Mu ..... F04B 1/0538 |
| 2017/0012439 | A1 | 1/2017 | Zhang et al. |
| 2017/0130712 | A1 | 5/2017 | Zhang et al. |
| 2018/0087499 | A1 | 3/2018 | Zhang et al. |
| 2018/0202423 | A1 | 7/2018 | Zhang et al. |
| 2019/0331117 | A1 * | 10/2019 | Gable ..... F04B 9/10 |

(Continued)

OTHER PUBLICATIONS

Unpublished U.S. Appl. No. 17/110,415, filed Dec. 3, 2020, (Copy not provided per Waiver of the Copy Requirement in 37 CFR 1.98 for Cited Pending U.S. Patent Applications).

*Primary Examiner* — Kenneth L Thompson

(57) ABSTRACT

A method may include monitoring, by a controller, operation of a pump of at least one hydraulic fracturing rig during ramp-up of the pump. Each of the at least one hydraulic fracturing rig may further include an engine and a transmission. The method may further include detecting, by the controller, an issue in the operation of the pump based on the monitoring of the operation and performing an action based on the detecting of the issue.

20 Claims, 5 Drawing Sheets

(56) References Cited

U.S. PATENT DOCUMENTS

| | | | | |
|---|---|---|---|---|
| 2020/0088202 | A1* | 3/2020 | Sigmar | F04D 13/02 |
| 2021/0025383 | A1 | 1/2021 | Bodishbaugh et al. | |
| 2021/0372394 | A1* | 12/2021 | Bagulayan | F04B 1/06 |
| 2021/0396118 | A1* | 12/2021 | Yeung | F04B 49/08 |
| 2022/0003229 | A1* | 1/2022 | Mu | F04B 17/06 |

* cited by examiner

MONITORING RAMP-UP PRESSURE OF A PUMP

TECHNICAL FIELD

The present disclosure relates generally to a hydraulic fracturing system that includes hydraulic fracturing rigs, and more particularly, to monitoring ramp-up pressure of pumps of the hydraulic fracturing rigs.

BACKGROUND

Hydraulic fracturing is a means for extracting oil and gas from rock, typically to supplement a horizontal drilling operation. In particular, high pressure fluid is used to fracture the rock, stimulating the flow of oil and gas through the rock to increase the volumes of oil or gas that can be recovered. A hydraulic fracturing rig used to inject high pressure fluid, or fracturing fluid, includes, among other components, an engine, transmission, driveshaft, and pump.

Hydraulic fracturing may involve the use of a hydraulic fracturing system that includes multiple hydraulic fracturing rigs operating at a pressure to achieve a flow rate for the fluid (e.g., measured in barrels per minute). In particular, a pump of the hydraulic fracturing rig may be ramped up to a specific flow and discharge pressure. During initial ramp-up, significant discharge pressure may be generated in a short amount of time (e.g., a few seconds) to work against the well head pressure and start the hydraulic fracturing process. However, the pump may experience issues during this ramp-up period, which may cause damage to the pump, may cause hydraulic fracturing operations to be delayed or performed incorrectly, and/or the like if not detected in a timely manner.

U.S. Pat. No. 9,342,055 B2, granted May 17, 2016 ("the '055 patent"), describes a wellbore servicing system that collects an electrical signal indicative of the pressure within a fluid supply flow path and processes the electrical signal to generate a lower pressure envelope signal. The lower pressure envelope is representative of a low pressure within the fluid supply flow path over a predetermined duration of time. The low pressure envelope signal is then compared to a predetermined lower threshold. However, the '055 patent does not monitor ramp-up pressure of a pump for issue detection and handling.

The present disclosure may solve one or more of the problems set forth above and/or other problems in the art. The scope of the current disclosure, however, is defined by the attached claims, and not by the ability to solve any specific problem.

SUMMARY

In one aspect, a hydraulic fracturing system may include at least one hydraulic fracturing rig, where each hydraulic fracturing rig may include an engine, a pump, and a transmission. The hydraulic fracturing system may further include a controller communicatively coupled to the at least one hydraulic fracturing rig. The controller may be configured to monitor operation of the pump during ramp-up of the pump, detect an issue in the operation of the pump based on the monitoring of the operation, and perform an action based on the detecting of the issue.

In another aspect, a method may include monitoring, by a controller, operation of a pump of at least one hydraulic fracturing rig during ramp-up of the pump. Each of the at least one hydraulic fracturing rig may further include an engine and a transmission. The method may further include detecting, by the controller, an issue in the operation of the pump based on the monitoring of the operation and performing an action based on the detecting of the issue.

In yet another aspect, a controller for a hydraulic fracturing system may include at least one hydraulic fracturing rig. Each hydraulic fracturing rig may include a pump, an engine, and a transmission. The controller may be configured to monitor operation of the pump during ramp-up of the pump and detect an issue in the operation of the pump based on the monitoring of the operation. The controller may be further configured to perform an action based on the detecting of the issue.

Other features and aspects of this disclosure will be apparent from the following description and the accompanying drawings.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION

Both the foregoing general description and the following detailed description are exemplary and explanatory only and are not restrictive of the features, as claimed. As used herein, the terms "comprises," "comprising," "has," "having," "includes," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus. In this disclosure, unless stated otherwise, relative terms, such as, for example, "about," "substantially," and "approximately" are used to indicate a possible variation of ±10% in the stated value.

Figure 1:
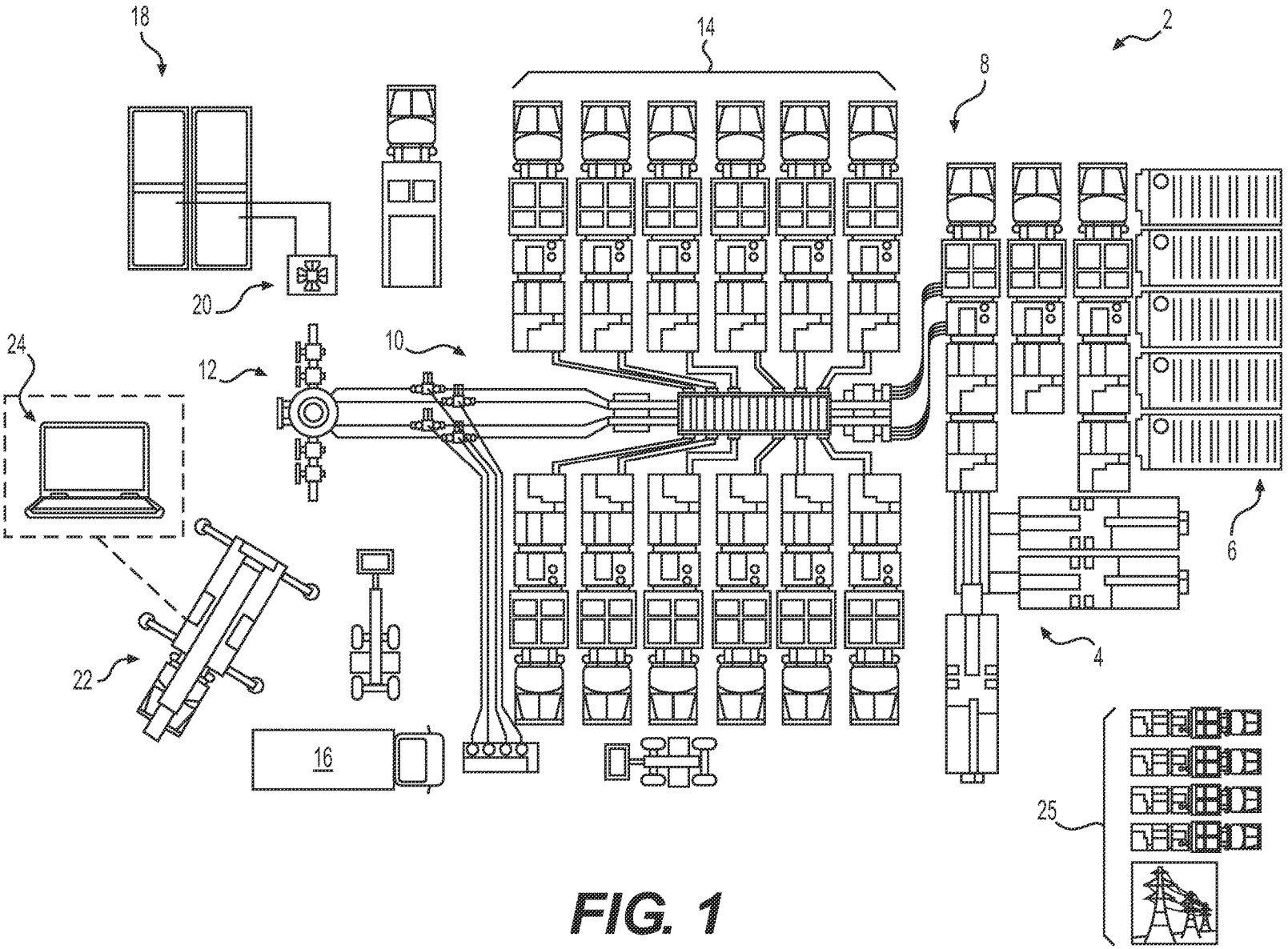
FIG. 1 is a schematic diagram of an exemplary hydraulic fracturing system including a mixed fleet of hydraulic fracturing rigs, according to aspects of the disclosure.

FIG. 1 illustrates an exemplary hydraulic fracturing system 2, according to aspects of the disclosure. In particular, FIG. 1 depicts an exemplary site layout according to a well stimulation stage (i.e., hydraulic fracturing stage) of a drilling/mining process, such as after a well has been drilled at the site and the equipment used for drilling removed. The hydraulic fracturing system 2 may include fluid storage tanks 4, sand storage tanks 6, and blending equipment 8 for preparing a fracturing fluid. The fracturing fluid, which may, for example, include water, sand, and one or more chemicals, may be injected at high pressure through one or more fluid lines 10 to a well head 12 using a plurality of hydraulic fracturing rigs 14. A hydraulic fracturing rig 14 may include a mechanical hydraulic fracturing rig 14 that includes, e.g., a gas or diesel engine, a pump, and a transmission. Alternatively, a hydraulic fracturing rig 14 may include an electric hydraulic fracturing rig 14 that includes, e.g., an electric motor, a variable frequency drive (VFD), and a pump.

A trailer-mounted bleed off tank 16 may be provided to receive bleed off liquid or gas from the fluid lines 10. In addition, nitrogen, which may be beneficial to the hydraulic fracturing process for a variety of reasons, may be stored in tanks 18, with a pumping system 20 used to supply the nitrogen from the tanks 18 to the fluid lines 10 or the well head 12.

The hydraulic fracturing process performed at the site, using the hydraulic fracturing system 2 of the present disclosure, and the equipment used in the process, may be managed and/or monitored from a single location, such as a data monitoring system 22, located at the site or at additional or alternative locations. According to an example, the data monitoring system 22 may be supported on a van, truck or may be otherwise mobile. As will be described below, the data monitoring system 22 may include a user device 24 for displaying or inputting data for monitoring performance and/or controlling operation of the hydraulic fracturing system 2. According to one embodiment, the data gathered by the data monitoring system 22 may be sent off-board or off-site for monitoring performance and/or performing calculations relative to the hydraulic fracturing system 2.

As further illustrated in FIG. 1, the hydraulic fracturing system 2 may include one or more power sources 25. For example, the one or more power sources may include one or more trailer-mounted generators (e.g., gas or diesel generators), a utility power grid, energy storages (e.g., batteries or hydrogen fuel cells), and/or the like. Additionally, or alternatively, the one or more power sources may include gas turbines, renewable power sources, such as solar panels or wind turbines, and/or the like.

Figure 2:
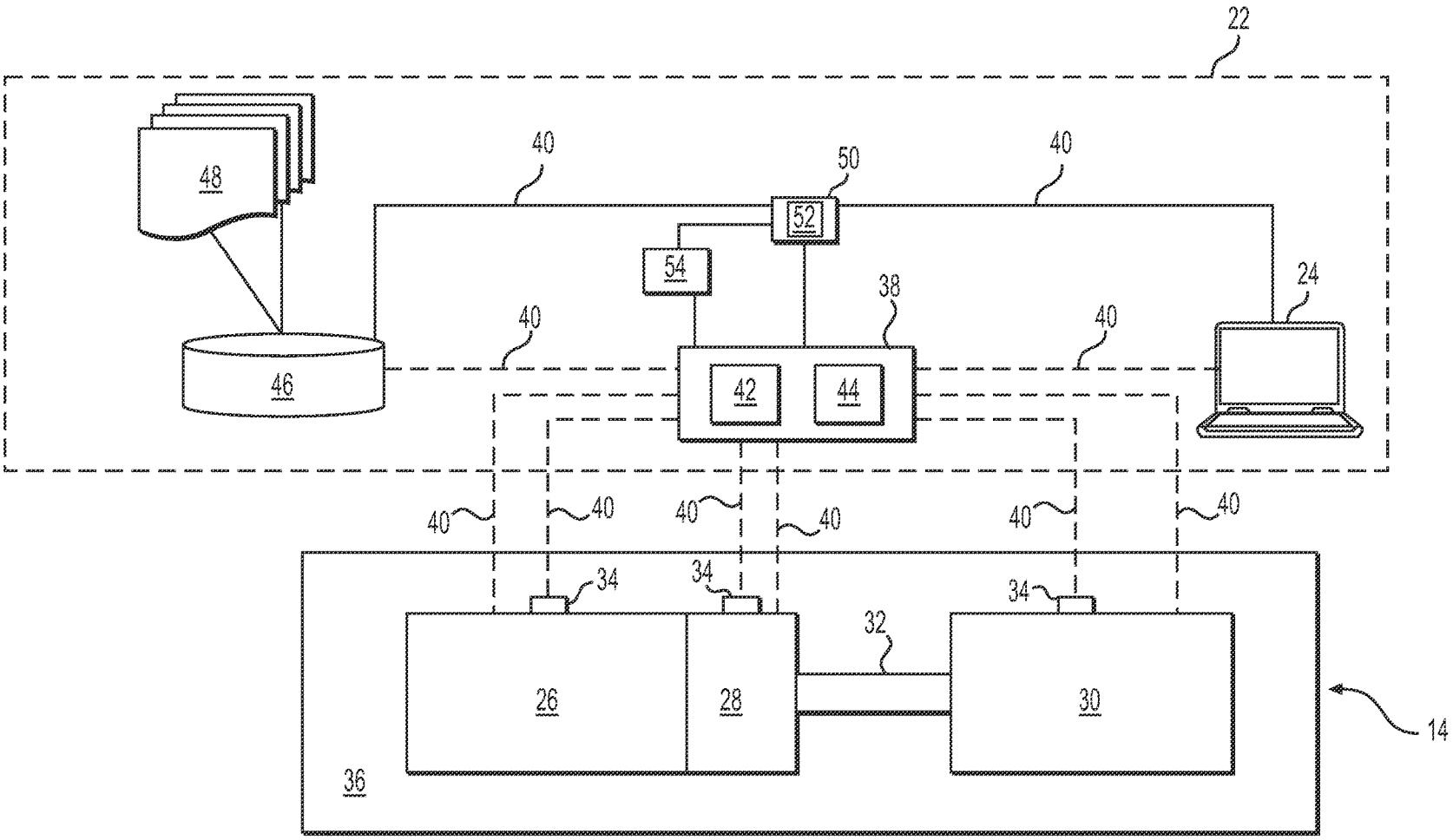
FIG. 2 is a schematic diagram of a hydraulic fracturing rig and associated systems of the hydraulic fracturing system of FIG. 1, according to aspects of the disclosure.

Referring to FIG. 2, the plurality of hydraulic fracturing rigs 14 may each generally include an engine 26 or other source of power (e.g., a turbine or an electric motor with a variable frequency drive (VFD) in the case of an electric hydraulic fracturing rig 14), a transmission 28, and a hydraulic fracturing pump 30. A driveshaft 32 may be coupled between the transmission 28 and the hydraulic fracturing pump 30 for transferring torque from the engine 26 to the hydraulic fracturing pump 30. One or more components of the hydraulic fracturing rig 14 may be, or may include, a fuel consumption component that is configured to consume fuel (e.g., diesel, natural gas, hydrogen, or synthesis gas) during operation of the hydraulic fracturing rig 14, and the engine 26 may be one example of a fuel consumption component. Additionally, or alternatively, one or more components of the hydraulic fracturing rig 14 may be, or may include, an emissions component that outputs emissions during operation of the hydraulic fracturing rig 14, and an exhaust of the engine 26 may be one example of an emissions component.

A hydraulic fracturing rig 14 may further include one or more systems configured to control or reduce emissions from the fuel consumption component or the emissions component. For example, the hydraulic fracturing rig 14 may include a selective catalytic reduction (SCR) system configured to implement a process where a reagent known as diesel exhaust fluid (DEF), such as urea or a water/urea solution, is selectively injected into the exhaust gas stream of the engine 26 and absorbed onto a downstream substrate in order to reduce the amount of nitrogen oxides in the exhaust gases. As another example, the hydraulic fracturing rig 14 may include an exhaust gas recirculation (EGR) system configured to recirculate a portion of the exhaust gasses from the engine 26 back into an air induction system for subsequent combustion. As yet another example, the hydraulic fracturing rig 14 may include a lean burn system configured to burn, or attempt to burn, gaseous fuel and air at a stoichiometrically lean equivalence ratio.

One or more sensors 34 may be positioned and configured to detect or measure one or more physical properties related to operation and/or performance of the various components of the hydraulic fracturing rig 14. For example, a sensor 34 may provide a sensor signal indicative of the fracturing fluid inlet or outlet pressure at pump 30, a sensor signal indicative of a rotational speed of an engine 26, a sensor signal indicative of a gear position of the transmission 28, a sensor signal indicative of an amount of fuel consumed by the engine 26, a sensor signal indicative of an amount of certain gasses or particulates in emissions from the engine 26, a temperature of the engine 26, and/or the like. The hydraulic fracturing rig 14 may be mobile, such as supported on a tractor-trailer 36, so that it may be more easily transported from site to site. Each of the hydraulic fracturing rigs 14 included in the hydraulic fracturing system 2 may or may not have similar configurations.

At least one controller 38 may be provided, and may be part of, or may communicate with, the data monitoring system 22. The controller 38 may reside in whole or in part at the data monitoring system 22, or elsewhere relative to the hydraulic fracturing system 2. Further, the controller 38 may be configured to communicate with the sensors 34 and/or various other systems or devices via wired and/or wireless communication lines 40, using available communication schemes, to monitor and control various aspects of each hydraulic fracturing rig 14 and/or each respective engine 26, transmission 28, and/or hydraulic fracturing pump 30. There may be one or more controllers 38 positioned at or supported on each component of the hydraulic fracturing rig 14, and one or more controllers 38 configured for coordinating control of the component-level controllers 38 and/or the overall hydraulic fracturing system 2.

The controller 38 may include a processor 42 and a memory 44. The processor 42 may include a central processing unit (CPU), a graphics processing unit (GPU), a microprocessor, a digital signal processor and/or other processing units or components. Additionally, or alternatively, the functionality described herein can be performed, at least in part, by one or more hardware logic components. For example, and without limitation, illustrative types of hardware logic components that may be used include field-programmable gate arrays (FPGAs), application-specific integrated circuits (ASICs), application-specific standard products (ASSPs), system-on-a-chip systems (SOCs), complex programmable logic devices (CPLDs), etc. Additionally, the processor 42 may possess its own local memory 44, which also may store program modules, program data, and/or one or more operating systems. The processor 42 may include one or more cores.

The memory 44 may be a non-transitory computer-readable medium that may include volatile and/or nonvolatile memory, removable and/or non-removable media implemented in any method or technology for storage of information, such as computer-readable instructions, data structures, program modules, or other data. Such memory includes, but is not limited to, random access memory (RAM), read-only memory (ROM), electrically erasable programmable read-only memory (EEPROM), flash memory or other memory technology, compact disc read-only memory (CD-ROM), digital versatile discs (DVD) or other optical storage, magnetic cassettes, magnetic tape, magnetic disk storage or other magnetic storage devices, redundant array of independent disks (RAID) storage systems, or any other medium which can be used to store the desired information and which can be accessed by a computing device (e.g., the user device 24, a server device, etc.). The memory 44 may be implemented as computer-readable storage media (CRSM), which may be any available physical media accessible by the processor 42 to execute instructions stored on the memory 44. The memory 44 may have an operating system (OS) and/or a variety of suitable applications stored thereon. The OS, when executed by the processor 42, may enable management of hardware and/or software resources of the controller 38.

The memory 44 may be capable of storing various computer readable instructions for performing certain operations described herein (e.g., operations of a site controller 50 and/or the controller 38). The instructions, when executed by the processor 42, may cause certain operations described herein to be performed.

In addition to the controller 38, the data monitoring system 22 may include, or may be in communication with, the site controller 50. Similar to the controller 38, the site controller 50 may reside in whole or in part at the data monitoring system 22, or elsewhere relative to the hydraulic fracturing system 2. Although the controller 38 and the site controller 50 may include similar components, the controller 38 may be associated with controlling a particular piece of equipment (or component thereof), such as a hydraulic fracturing rig 14, whereas the site controller 50 may control and/or coordinate operations of multiple pieces of equipment, such as multiple hydraulic fracturing rigs 14 or a combination of a hydraulic fracturing rig 14 and the blending equipment 8 at a site or across multiple sites.

Although not illustrated in FIG. 2, the site controller 50 may also include a processor 42 and a memory 44. The site controller 50 may be configured to communicate with the controller 38 and/or various other systems or devices via wired and/or wireless communication lines 40 to monitor and/or control various aspects of the hydraulic fracturing rig 14 or components thereof, as described elsewhere herein. For instance, the site controller 50 may store and/or execute an optimization program 52 to optimize fuel costs and/or emissions costs of the hydraulic fracturing rig 14 and/or the hydraulic fracturing system 2 (e.g., based on data stored in the memory 44 of the site controller 50 or as otherwise provided to the site controller 50, such as via the user device 24 or from database 46 as data 48). Data used by the site controller 50 may include power supply operation-related information, cost-related information, power demand-related information, or operational priority and/or site configuration-related information, as described elsewhere herein. However, various other additional or alternative data may be used.

The data monitoring system 22 may further include a load manager 54. The load manager 54 may include a processor 42 and a memory 44 (not illustrated in FIG. 2) and may be configured to determine a power demand for the engine 26 based on, for example, operator input related to fracturing operations at a site.

INDUSTRIAL APPLICABILITY

The aspects of the site controller 50 of the present disclosure and, in particular, the methods executed by the site controller 50 may be used to monitor ramp-up pressure of a pump of a hydraulic fracturing rig 14. For example, the methods executed by the site controller 50 may detect various issues in the pump operation and may take corrective or preventative actions based on the detected issues. Thus, certain aspects described herein may provide various advantages to the operation of a hydraulic fracturing rig 14, such as reduction or elimination of damage to a pump during ramp-up, reduction or elimination of pump-caused delay in hydraulic fracturing operations, and/or the like.

Figure 3A:
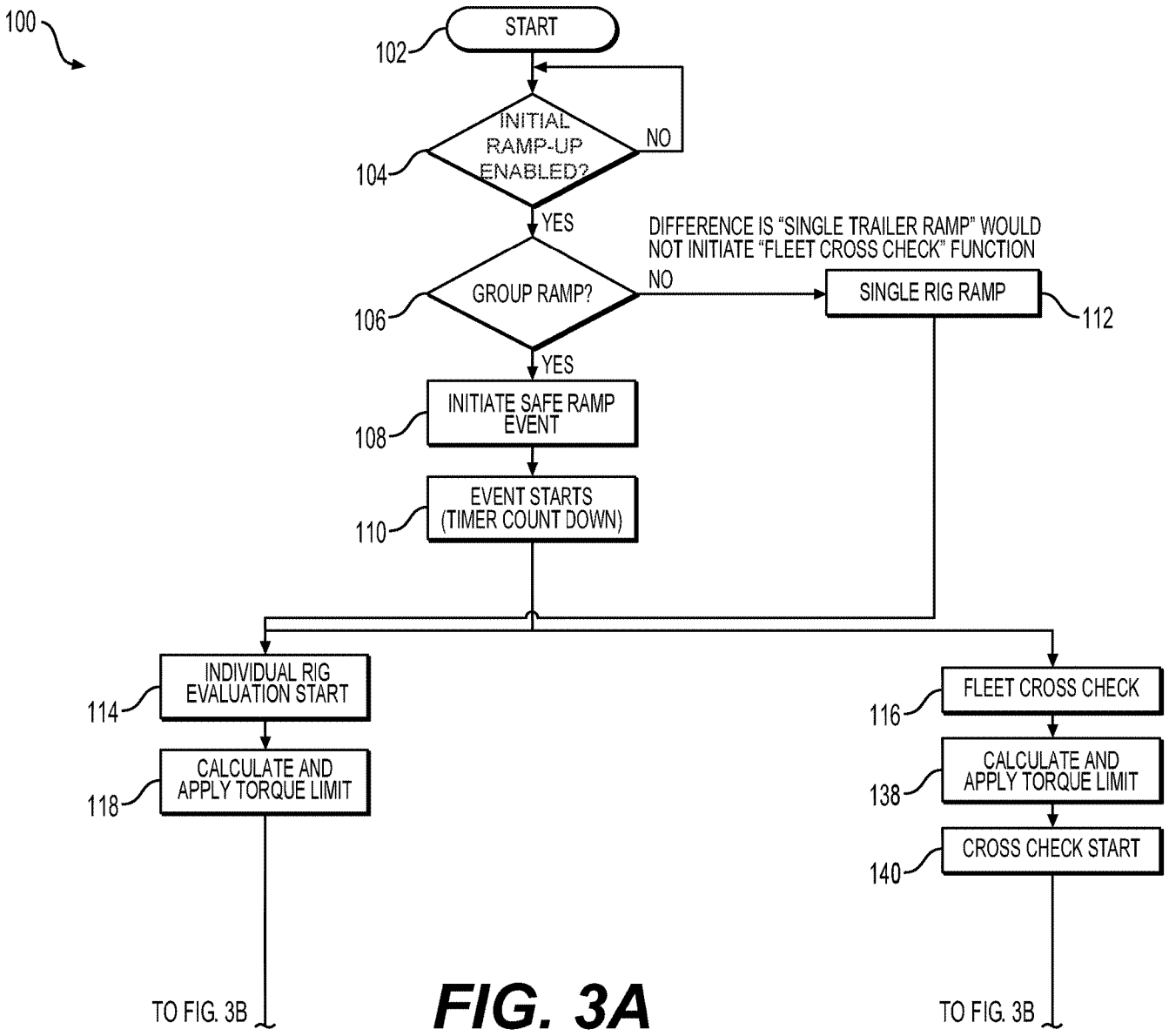
FIG. 3A illustrates a portion of a flowchart depicting an exemplary method for monitoring ramp-up pressure of a pump, according to aspects of the disclosure.
Figure 3B:
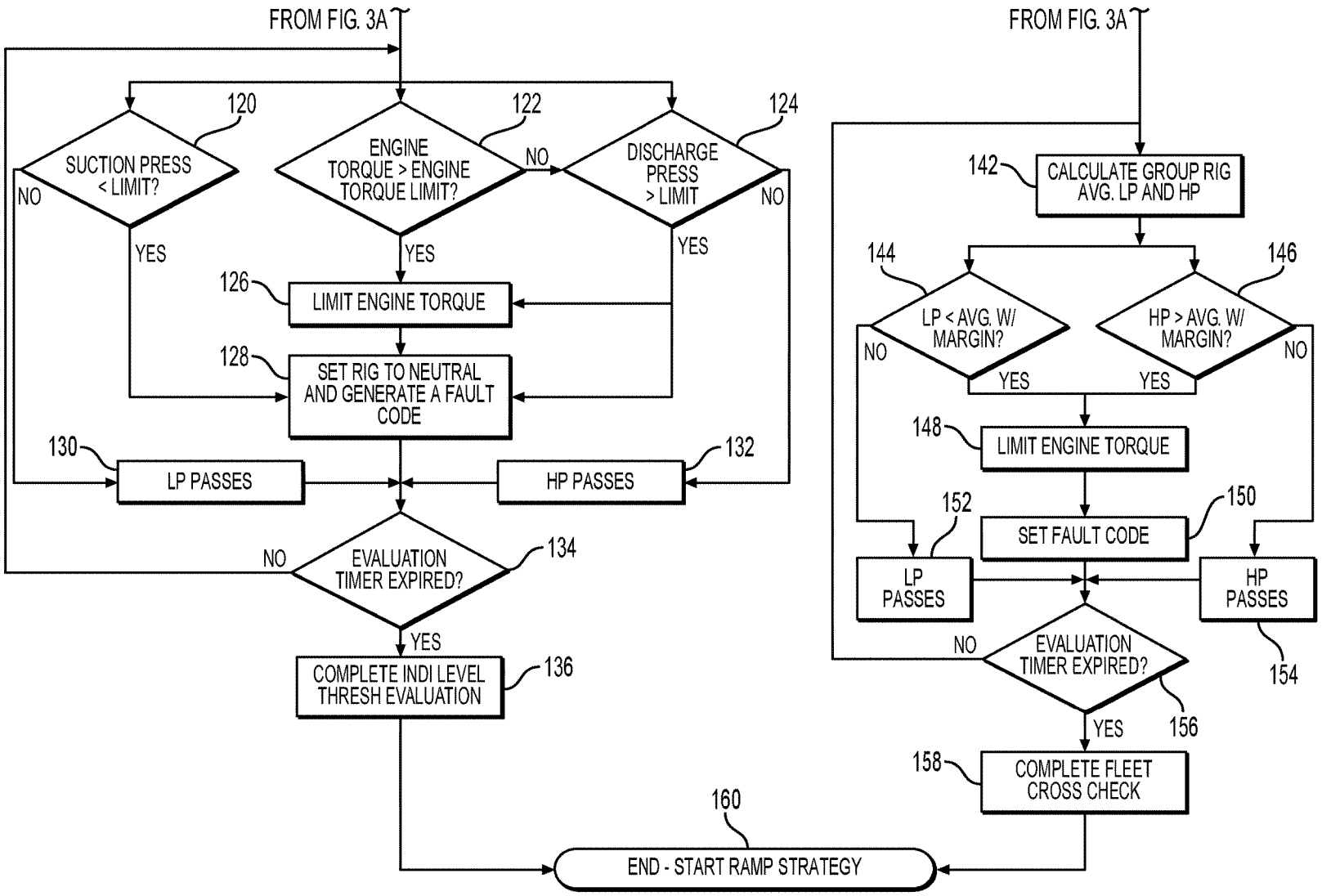
FIG. 3B illustrates another portion of the flowchart depicting the exemplary method for monitoring ramp-up pressure of a pump.

FIGS. 3A and 3B illustrate a flowchart depicting an exemplary method 100 for monitoring ramp-up pressure of a pump, according to aspects of the disclosure. For example, the site controller 50 may perform the method illustrated in FIGS. 3A and 3B.

As illustrated at 102, the method 100 may be started by the site controller 50 based on the starting of a hydraulic fracturing rig 14, based on an input command from a user device 24, and/or the like. As illustrated at 104, the method 100 may include determining whether an initial pump ramp-up is enabled. For example, the site controller 50 may make the determination at step 104 based on various conditions. The conditions may include whether the site controller 50 has received a flow command for the hydraulic fracturing rig 14, whether the hydraulic fracturing rig 14 (or a fleet of hydraulic fracturing rigs 14) is in an idle or neutral state and a certain operational mode, whether the site controller 50 has received a command to change the engine speed from idle to high or has received a transmission output speed (TOS) command, whether the site controller 50 has received a command to change a gear from transmission parking or neutral mode (P/N) to a particular gear number, and/or the like. If the site controller 50 determines that the initial ramp is not enabled (104—NO), then the controller may wait (and periodically check) for satisfaction of one or more of the previously-described conditions. If the site controller 50 determines that the initial ramp is enabled (104—YES), then the method 100 may include, at 106, determining whether to perform a group ramp of pumps of a group of hydraulic fracturing rigs 14. For example, the site controller 50 may determine whether a pump of a single hydraulic fracturing rig 14 or pumps of multiple hydraulic fracturing rigs 14 are to be ramped.

If the site controller 50 determines that the group ramp is to be performed (106—YES), then the method 100 may include, at 108, initiating a safe ramp event. For example, the site controller 50 may determine a target pump speed or TOS, a transmission gear number, a speed ramp rate, an event timer, a pump pressure limit, and/or the like for the pumps of the group of hydraulic fracturing rigs 14 in connection with initiating the safe ramp event. The method 100 may then include, at 110, starting the safe ramp event and initiating countdown of the timer. If the site controller 50 determines to not perform the group ramp (106—NO), then the method 100 may include, at 112, performing a ramp-up of a single hydraulic fracturing rig 14.

As described in more detail below, the site controller 50 may start an evaluation of an individual hydraulic fracturing rig 14 at 114 and/or may perform a fleet cross check of a group of hydraulic fracturing rigs 14 at 116, depending on whether the site controller 50 determined to perform the group ramp at 106. In the case of both the group ramp (after starting the safe event ramp at 110) and performing the single rig 14 ramp at 112, the method 100 may include, at 114, starting the evaluation of each individual hydraulic fracturing rig 14. As illustrated at 118, the method 100 may include calculating a torque limit for the hydraulic fracturing rig 14 and may apply the torque limit by sending a command to the hydraulic fracturing rig 14 to cause the hydraulic fracturing rig 14 to operate according to the limit, by using the torque limit in various determinations, and/or the like.

Turning to FIG. 3B, and as illustrated at 120, the method 100 may include determining whether a suction pressure ("suction press") of the hydraulic fracturing rig 14 is less than (or less than or equal to) a limit. The site controller 50 may receive a signal indicative of the suction pressure from a sensor located at or near an inlet to the pump of the hydraulic fracturing rig 14. Additionally, or alternatively, as illustrated at 122, the method 100 may include determining whether an engine torque of the hydraulic fracturing rig 14 is greater than (or greater than or equal to) an engine torque limit. The site controller 50 may receive a signal indicative of the engine torque from a sensor located on the engine of the hydraulic fracturing rig 14. Additionally, or alternatively, as illustrated at 124, the method 100 may include determining whether a discharge pressure ("discharge press") of the hydraulic fracturing rig 14 is greater than (or greater than or equal to) a limit. The site controller 50 may receive a signal indicative of the discharge pressure from a sensor located at or near an outlet of the pump of the hydraulic fracturing rig 14. The determination at 124 may be performed if the engine torque is not greater than (or not greater than or equal to) the engine torque limit (122—NO). Alternatively, if the engine torque is greater than (or greater than or equal to) the engine torque limit (122—YES), then the method 100 may include limiting the engine torque at 126 and then setting the transmission of the hydraulic fracturing rig 14 to neutral and generating a fault code.

Returning to the determination at 120, if the suction pressure is less than (or less than or equal to) the limit (120—YES), then the method 100 may include performing the operations at 128. Alternatively, if the suction pressure is not less than (or not less than or equal to) the limit (120—NO), then the method 100 may include determining that the low pressure (LP) of the hydraulic fracturing rig 14 passes at 130. Returning to the determination at 124, if the discharge pressure is greater than (or greater than or equal to) the limit (124—YES), then the method 100 may include performing the operations at 126 and/or 128. Alternatively, if the discharge pressure is not greater than (or not greater than or equal to) the limit (124—NO), then the method 100 may include determining that the high pressure (HP) of the hydraulic fracturing rig 14 passes at 132.

After the operations at 128, 130, and 132, the method 100 may include determining whether an evaluation timer (e.g., the timer initiated at 110) has expired at 134. If the timer has not expired (134—NO), then the method 100 may include returning to performing the determinations at 120, 122, and 124. Alternatively, if the evaluation timer has expired (134—YES), then the method 100 may include completing the individual ("INDI") level threshold ("THRESH") evaluation at 136.

Returning to FIG. 3A, if the method 100 includes performing the fleet cross check at 116, then the method 100 may include, at 138, calculating a torque limit for hydraulic fracturing rigs 14 of a group of hydraulic fracturing rigs 14 and applying the torque limit to the hydraulic fracturing rigs 14 (e.g., in a manner similar to that described in connection with the operation at 118). As illustrated at 140, the method 100 may include starting the cross check of the fleet of hydraulic fracturing rigs 14.

Turning to FIG. 3B, the method 100 may include calculating an average ("AVG.") low pressure and high pressure for hydraulic fracturing rigs 14 of the group of hydraulic fracturing rigs 14. At 144, the method 100 may include determining whether a low pressure of each hydraulic fracturing rig 14 is less than (or less than or equal to) the average low pressure with a margin. For example, the site controller 50 may receive a signal indicative of the low pressure of the pump of a hydraulic fracturing rig 14 from a sensor located at or near the inlet to the pump. At 146, the method 100 may include determining whether the high pressure for each hydraulic fracturing rig 14 is greater than (or greater than or equal to) the average high pressure with a margin. For example, the site controller 50 may receive a signal indicative of the high pressure of the pump of a hydraulic fracturing rig 14 from a sensor located at or near the outlet from the pump. As illustrated at 148, if either the low pressure is less than (or less than or equal to) the average with a margin (144—YES) or the high pressure is greater than (or greater than or equal to) the average high pressure with a margin (146—YES), then the method 100 may include limiting the engine torque. In addition, the method 100 may include setting a fault code at 150. If the low pressure is not less than (or not less than or equal to) the average with a margin (144—NO), then the method 100 may include determining that the low pressure of the group of hydraulic fracturing rigs 14 passes. If the high pressure is not greater than (or not greater than or equal to) the average with a margin (146—NO), then the method 100 may include determining that the high pressure of the group of hydraulic fracturing rigs 14 passes.

As illustrated at 156, the method 100 may include determining whether an evaluation timer (e.g., the evaluation timer initiated at 110) has expired. If the timer has not expired (156—NO), then the method 100 may return to the operation illustrated at 142. Alternatively, if the evaluation timer has expired (156—YES), then the method 100 may include completing the fleet cross check at 158. As illustrated at 160, after the operations at 136 and 158, the method 100 may include ending the method 100 and starting a ramp strategy.

Figure 4:
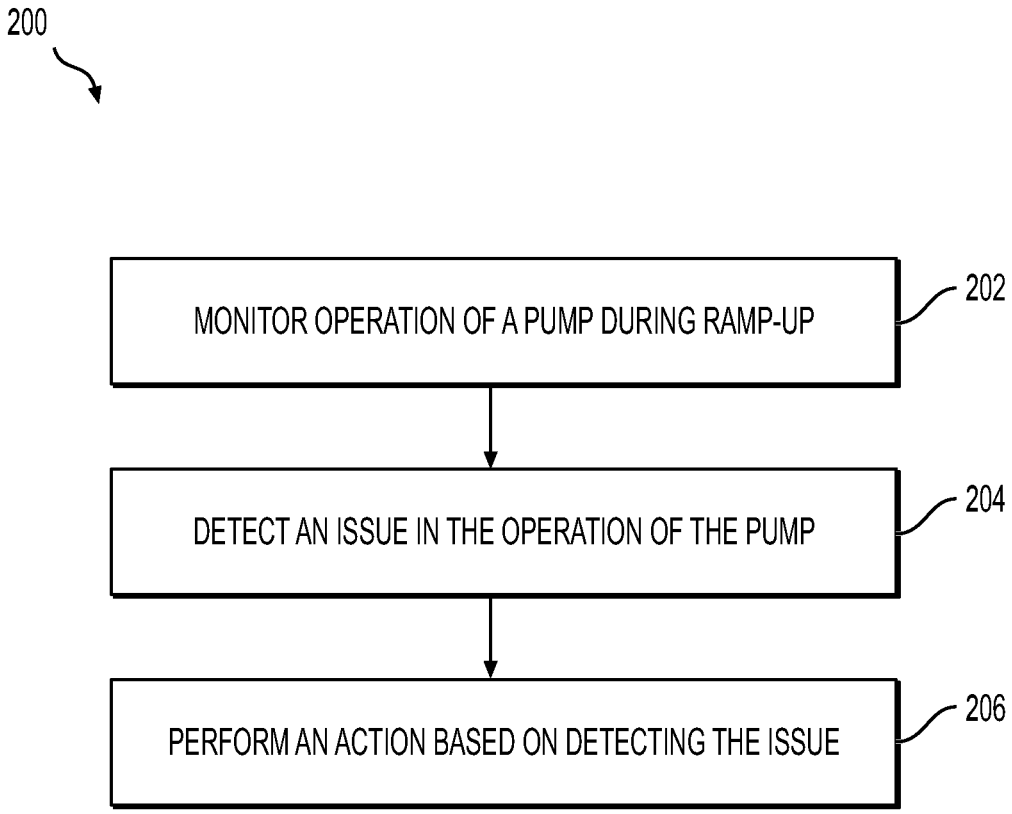
FIG. 4 illustrates another flowchart depicting an exemplary method for monitoring ramp-up pressure of a pump, according to aspects of the disclosure.

FIG. 4 illustrates a flowchart depicting an exemplary method 200 for monitoring ramp-up pressure of a pump, according to aspects of the disclosure. The method 200 illustrated in FIG. 4 may be implemented by the site controller 50. The steps of the method 200 described herein may be embodied as machine readable and executable software instructions, software code, or executable computer programs stored in a memory and executed by a processor of the site controller 50. The software instructions may be further embodied in one or more routines, subroutines, or modules and may utilize various auxiliary libraries and input/output functions to communicate with other equipment. The method illustrated in FIG. 4 may also be associated with an operator interface (e.g., a human-machine interface). Therefore, the method 200 may be implemented by the site controller 50 to provide for monitoring ramp-up pressure of a pump, for example.

As illustrated at 202, the method 200 may include monitoring operation of a pump during ramp-up. For example, the site controller 50 may monitor various parameters of operation of a pump and/or other components of the hydraulic fracturing rig 14 during ramp-up of the pump. For example, the various parameters may include a suction pressure (e.g., a low side pressure), a discharge pressure (e.g., a high side pressure), an engine torque, and/or the like. The site controller 50 may monitor the operation continuously, by receiving a stream of data from sensors associated with a hydraulic fracturing rig 14 (e.g., sensors on the pump for pump pressure, on the engine for engine torque, etc.), based on requesting data from the hydraulic fracturing rig 14 (e.g., the hydraulic fracturing rig 14 may gather data for the various parameters and may provide a consolidated report to the site controller 50), and/or the like.

The monitoring at 202 may include performing an individual hydraulic fracturing rig 14 evaluation (e.g., in a manner similar to that described in connection with the operations at 114 and 118 through 136 of FIGS. 3A and 3B). The site controller 50 may perform the individual hydraulic fracturing rig 14 evaluation after determining to not perform a group ramp (e.g., in a manner similar to that described at 106 of FIG. 3A). Additionally, or alternatively, the monitoring at 202 may include performing both the individual hydraulic fracturing rig 14 evaluation and a fleet cross check (e.g., the fleet cross check may be performed in a manner similar to that at 116 and 138 through 158 of FIGS. 3A and 3B). The site controller 50 may perform the individual hydraulic fracturing rig 14 evaluation and the fleet cross check based on determining to perform the group ramp.

When performing the individual hydraulic fracturing rig 14 evaluation and/or the fleet cross check, the site controller 50 may determine a torque limit for an engine of the hydraulic fracturing rig 14 and applying the torque limit to the engine. For example, to apply the torque limit, the site controller 50 may send a control signal or instruction to a hydraulic fracturing rig 14 to try to limit the torque of the hydraulic fracturing rig 14, may use the torque limit in various determinations (e.g., at 122 of FIG. 3B), and/or the like. When performing the fleet cross check, the site controller 50 may further determine an average low pressure for a low pressure side (e.g., suction side) of the pump and an average high pressure for a high pressure side (e.g., discharge side) of the pump across a group of hydraulic fracturing rigs 14. The site controller 50 may determine the average pressures based on pressure data from sensors associated with pumps of the group of hydraulic fracturing rigs 14.

As illustrated at 204, the method 200 may include detecting an issue in the operation of the pump. For example, the site controller 50 may detect the issue based on a comparison of operation-related data to a threshold or limit. An issue may include a deviation from expected operation of a hydraulic fracturing rig 14, operations of the hydraulic fracturing rig 14 that exceed or fail to exceed certain limits, a malfunction in the operation of the hydraulic fracturing rig 14, and/or the like.

When performing the individual hydraulic fracturing rig 14 evaluation described above, the site controller 50 may perform various determinations to detect the issue. For example, the site controller 50 may determine whether a suction pressure of the pump is less than (or less than or equal to) a suction limit (e.g., in a manner similar to that at 120 of FIG. 3B). Additionally, or alternatively, the site controller 50 may determine whether a torque limit of the engine of the hydraulic fracturing rig 14 is greater than (or greater than or equal to) an engine torque limit (e.g., in a manner similar to that at 122 of FIG. 3B). Additionally, or alternatively, the site controller 50 may determine whether a discharge pressure of the pump is greater than (or greater than or equal to) a discharge pressure limit (e.g., in a manner similar to that at 124 of FIG. 3B).

When performing the fleet cross check described above, the site controller 50 may perform various determinations to detect the issue in the operation of the pump. For example, the site controller 50 may determine whether a low pressure side of the pump is less than (or less than or equal to) an average low pressure with a margin (e.g., in a manner similar to that at 144 of FIG. 3B). The margin may allow for some variability in the measured low pressure such that average low pressure is not a strict limit. Additionally, or alternatively, the site controller 50 may determine whether a high pressure side of the pump is greater than (or greater than or equal to) an average high pressure with a margin (e.g., in a manner similar to that at 146 of FIG. 3B). The margin for the high pressure may allow for a similar variability in measured values as the low pressure margin.

At step 206, the method 200 may include performing an action based on detecting the issue. For example, the site controller 50 may perform the action automatically, may cause a GUI to be displayed on the user device 24 for user selection of an action from various actions and/or approval of an action, and/or the like. The site controller 50 may perform the action after detecting the issue, may schedule the action, and/or the like.

When performing the action, the site controller 50 may limit the torque of the engine based on the torque being greater than (or greater than or equal to) an engine torque limit (e.g., in a manner similar to that at 126 of FIG. 3B). Additionally, or alternatively, the site controller 50 may limit the torque of the engine based on the discharge pressure being greater than (or greater than or equal to) the discharge pressure limit (e.g., in a manner similar to that at 126 of FIG. 3B). When performing the action, the site controller 50 may set the transmission of the at least one hydraulic fracturing rig 14 to neutral or may generate a fault code (e.g., in a manner similar to that at 128 of FIG. 3B). For example, these actions may be based on the suction pressure being less than (or less than or equal to) a suction limit (e.g., in a manner similar to that at 120 of FIG. 3B), the discharge pressure of the pump being greater than (or greater than or equal to) the discharge pressure limit (e.g., in a manner similar to that at 122 of FIG. 3B), and/or the torque of the engine having been limited (e.g., in a manner similar to that at 124 of FIG. 3B).

When performing the action, the site controller 50 may limit a torque of the engine based on the low pressure side of the pump being less than (or less than or equal to) the average low pressure or based on the high pressure side of the pump being greater than (or greater than or equal to) the average high pressure. For example, the limiting of the torque may be performed in a manner similar to that at 148 of FIG. 3B). The controller may then generate a fault code after limiting the torque (e.g., in a manner similar to that at 150 of FIG. 3B).

The site controller 50 may perform various other actions. For example, the site controller 50 may trigger an alarm based on detecting the issue or based on the particular type of issue detected (e.g., different alarms may be triggered for suction pressure issues, discharge pressure issues, engine torque issues, and/or the like). Additionally, or alternatively, the site controller 50 may display a message on a user device 24 or may send a message to an account of a user of the user device 24. For example, the message may identify the issue detected, an action performed, and/or the like. Additionally, or alternatively, the site controller 50 may generate a request for maintenance based on the detected issue and may send the request to a user device 24 associated with maintenance personnel.

Although the method 200 illustrated in FIG. 4 is described as including steps 202 to 206, the method 200 may not include all of these steps or may include additional or different steps. For example, the method 200 may just include step 204.

The site controller 50 of the present disclosure can provide real-time (or near real-time) monitoring of ramp-up pressure of a pump of a hydraulic fracturing rig 14. Thus, aspects of the present disclosure may detect issues with pump operation and may take corrective or preventative action before the issues disrupt hydraulic fracturing operations or cause damage to the pump. This may improve hydraulic fracturing operations by preventing unnecessary delay in the operations and/or helping to ensure that the operations are performed in an intended manner. In addition, this may conserve resources that would otherwise be needed to repair a damaged pump as a result of ramp-up issues, may help to extend the operational life of a pump, and/or the like.

It will be apparent to those skilled in the art that various modifications and variations can be made to the disclosed system without departing from the scope of the disclosure. Other embodiments of the system will be apparent to those skilled in the art from consideration of the specification and practice of the system disclosed herein. It is intended that the specification and examples be considered as exemplary only, with a true scope of the disclosure being indicated by the following claims and their equivalents.

What is claimed is:

1. A hydraulic fracturing system, comprising:
at least one hydraulic fracturing rig,
wherein each hydraulic fracturing rig comprises an engine, a pump, and a transmission; and
a controller communicatively coupled to the at least one hydraulic fracturing rig, wherein the controller is configured to:
monitor operation of the pump during ramp-up of the pump;
determine whether to perform a group ramp of the at least one hydraulic fracturing rig;
perform, when monitoring the operation:
an individual hydraulic fracturing rig evaluation based on determining to not perform the group ramp, or
both the individual hydraulic fracturing rig evaluation and a fleet cross check based on determining to perform the group ramp;
detect an issue in the operation of the pump based on the monitoring of the operation; and
perform an action based on the detecting of the issue.

2. The hydraulic fracturing system of claim 1, wherein the controller is further configured, when performing the individual hydraulic fracturing rig evaluation, to:
determine a torque limit for the engine; and
apply the torque limit to the engine.

3. The hydraulic fracturing system of claim 1, wherein the controller is further configured, when performing the individual hydraulic fracturing rig evaluation, to:
determine at least one of:
whether a suction pressure of the pump is less than, or less than or equal to, a suction limit,
whether a torque of the engine is greater than, or greater than or equal to, an engine torque limit, or
whether a discharge pressure of the pump is greater than, or greater than or equal to, a discharge pressure limit.

4. The hydraulic fracturing system of claim 3, wherein the controller is further configured, when performing the action, to:
limit the torque of the engine based on the torque being greater than, or greater than or equal to, the engine torque limit or based on the discharge pressure being greater than, or greater than or equal to, the discharge pressure limit, or
set the transmission of the at least one hydraulic fracturing rig to neutral or generate a fault code based on:
the suction pressure being less than, or less than or equal to, the suction limit,
the discharge pressure of the pump being greater than, or greater than or equal to, the discharge pressure limit, or
the torque of the engine having been limited.

5. The hydraulic fracturing system of claim 1, wherein the controller is further configured, when performing the fleet cross check, to:
determine a torque limit for the engine;
apply the torque limit to the engine; and
determine an average low pressure for a low pressure side of the pump and an average high pressure for a high pressure side of the pump for a group of hydraulic fracturing rigs.

6. The hydraulic fracturing system of claim 1, wherein the controller is further configured, when performing the fleet cross check, to:
determine whether a low pressure side of the pump is less than, or less than or equal to, an average low pressure with a margin, or
determine whether a high pressure side of the pump is greater than, or greater than or equal to, an average high pressure with a margin.

7. The hydraulic fracturing system of claim 1, wherein the controller is further configured, when performing the fleet cross check, to:
limit a torque of the engine based on a low pressure side of the pump being less than, or less than or equal to, an average low pressure or based on a high pressure side of the pump being greater than, or greater than or equal to, an average high pressure; and
generate a fault code.

8. The hydraulic fracturing system of claim 1, wherein the controller is further configured, when performing the action, to:
based on detecting the issue:
trigger an alarm, or
display a message on a user device.

9. The hydraulic fracturing system of claim 1, wherein the at least one hydraulic fracturing rig includes multiple hydraulic fracturing rigs, and wherein the controller is further configured, based on determining to perform the group ramp, to ramp-up respective pumps of the multiple hydraulic fracturing rigs.

10. A method, comprising:
monitoring, by a controller, operation of a pump of at least one hydraulic fracturing rig during ramp-up of the pump,
wherein each of the at least one hydraulic fracturing rig further comprises an engine and a transmission;
determining whether to perform a group ramp of the at least one hydraulic fracturing rig, wherein the monitoring of the operation includes:
performing an individual hydraulic fracturing rig evaluation based on determining to not perform the group ramp, or
performing both the individual hydraulic fracturing rig evaluation and a fleet cross check based on determining to perform the group ramp;
detecting, by the controller, an issue in the operation of the pump based on the monitoring of the operation; and
performing an action based on the detecting of the issue.

11. The method of claim 10, wherein the performing of the individual hydraulic fracturing rig evaluation further comprises:

determining a torque limit for the engine; and applying the torque limit to the engine.

12. The method of claim 10, wherein the performing of the individual hydraulic fracturing rig evaluation further comprises:

determining at least one of:

whether a suction pressure of the pump is less than, or less than or equal to, a suction limit, whether a torque of the engine is greater than, or greater than or equal to, an engine torque limit, or whether a discharge pressure of the pump is greater than, or greater than or equal to, a discharge pressure limit.

13. The method of claim 12, wherein the performing of the action further comprises:

limiting the torque of the engine based on the torque being greater than, or greater than or equal to, the engine torque limit or based on the discharge pressure being greater than, or greater than or equal to, the discharge pressure limit, or setting the transmission of the at least one hydraulic fracturing rig to neutral or generate a fault code based on:

the suction pressure being less than, or less than or equal to, the suction limit, the discharge pressure of the pump being greater than, or greater than or equal to, the discharge pressure limit, or the torque of the engine having been limited.

14. The method of claim 10, wherein the at least one hydraulic fracturing rig includes multiple hydraulic fracturing rigs, and wherein the method further includes, based on determining to perform the group ramp, ramping-up respective pumps of the multiple hydraulic fracturing rigs.

15. A controller for a hydraulic fracturing system comprising at least one hydraulic fracturing rig, each hydraulic fracturing rig comprising a pump, an engine, and a transmission, the controller being configured to:

monitor operation of the pump during ramp-up of the pump;

determine whether to perform a group ramp of the at least one hydraulic fracturing rig;

perform, when monitoring the operation:

an individual hydraulic fracturing rig evaluation based on determining to not perform the group ramp, or both the individual hydraulic fracturing rig evaluation and a fleet cross check based on determining to perform the group ramp;

detect an issue in the operation of the pump based on the monitoring of the operation; and perform an action based on the detecting of the issue.

16. The controller of claim 15, wherein the controller is further configured, when performing the fleet cross check, to:

determine a torque limit for the engine;

apply the torque limit to the engine; and determine an average low pressure for a low pressure side of the pump and an average high pressure for a high pressure side of the pump for a group of hydraulic fracturing rigs.

17. The controller of claim 15, wherein the controller is further configured, when performing the fleet cross check, to:

determine whether a low pressure side of the pump is less than, or less than or equal to, an average low pressure with a margin, or determine whether a high pressure side of the pump is greater than, or greater than or equal to, an average high pressure with a margin.

18. The controller of claim 15, wherein the controller is further configured, when performing the fleet cross check, to:

limit a torque of the engine based on a low pressure side of the pump being less than, or less than or equal to, an average low pressure or based on a high pressure side of the pump being greater than, or greater than or equal to, an average high pressure; and generate a fault code.

19. The controller of claim 15, wherein the controller is further configured, when performing the action, to:

based on detecting the issue:

trigger an alarm, or display a message on a user device.

20. The controller of claim 15, wherein the at least one hydraulic fracturing rig includes multiple hydraulic fracturing rigs, and wherein the controller is further configured, based on determining to perform the group ramp, to ramp-up respective pumps of the multiple hydraulic fracturing rigs.

* * * * *